United States Patent [19]

Rehberg

[11] 4,390,570

[45] Jun. 28, 1983

[54] FLUID ROOF SYSTEM

[75] Inventor: Irene L. Rehberg, Strongsville, Ohio

[73] Assignee: Elastic Coating Systems, Inc., Medina, Ohio

[21] Appl. No.: 332,887

[22] Filed: Dec. 21, 1981

[51] Int. Cl.[3] ..... B05D 3/02

[52] U.S. Cl. ..... 427/385.5; 427/393.6; 524/522; 524/523; 525/221; 525/228

[58] Field of Search ..... 427/393.6, 385.5; 524/501, 522, 523; 525/221, 228

[56] References Cited

U.S. PATENT DOCUMENTS

| | | | |
|---|---|---|---|
| 3,106,486 | 10/1963 | Harron et al. | 427/393.6 X |
| 3,366,590 | 1/1968 | Taft | 260/29.6 |
| 3,785,860 | 1/1974 | Zdanowski | 427/393.6 X |
| 3,947,397 | 3/1976 | Schuster et al. | 427/393.6 X |
| 4,150,005 | 4/1979 | Gehman et al. | 260/28.5 R |
| 4,196,259 | 4/1980 | Augustin et al. | 427/393.6 X |

OTHER PUBLICATIONS

United Coatings Technical Data for Diathon (Jul., 1981).

Universal Coatings Systems, Inc. Technical Dala for Geotherm, Elastomer FR Coating.

Thermo Materials Incorporated Brochure for Thermo Super Prep, Proven Protective Elastomeric Coating.

Conklin Company, Inc. Brochure on Rapid Roof, an Energy Saving Roofing System that Shields Against the Elements (Rev. Feb. 1981).

Futura Coatings, Inc. Technical Data on Acro Bond 440/442, Acrylic Elastomer (Jan., 1981).

H. B. Fuller Company Brochure on Atralar, Monolar II and Duralar, Jun., 1981, 10M/IMP.

Anchor Coatings, Inc. Brochure on Anchor Sun Shield-790A, #6015A and #6016 (1981).

Plastic Coatings Corp. Brochure on Jaxsan 600/Polyurethane Foam System.

Era Corporation Technical Data Guide for Era-Guard, (1981).

Foam Systems Co. Technical Data on Acryflex, Elastomeric Protective Coating.

The Neogard Corporation, "Put a Lid on Your Energy Losses and Stop Costly Roof Leaks in One Economical Installation".

Carboline, Data Sheet on Chem-Elast 5226, Elastomeric Coating.

Gaco Western, Inc. Brochure on Gacoflex Foam Coatings Systems (1/82).

Rohm and Haas Physical Properties for Experimental Emulsion E-1685 (Product Bulletin).

100% Acrylic Emulsions Parcryl (Product Bulletin).

Recommended Usage Levels of Skane M-8 (Product Bulletin).

Hercules Incorporated Natrosol 250 (Product Data).

Diamond Shamrock Nopco NXZ (Product Bulletin).

Gulf & Western Zinc Division Kadox-515 (Pigment Data Sheet).

Mid-America Chemical Corporation, Ammonium Hydroxide (Data Sheet).

FMC Corporation, Potassium Tripolyphosphate (Technical Data).

Mid-America Chemical Corporation, Ethylene Glycol (Data Sheet).

Mid-America Chemical Corporation, Texanol, (Tech. Data Sheet).

DuPont Ti-Pure R-960, Rutile Titanium Dioxide (Data Sheet).

Camel-Tex (Product Brochure).

Tamol 731 (25%) and Tamol 850 (30%), (Rohm & Haas Product Data Sheet).

*Primary Examiner*—Michael R. Lusignan

*Attorney, Agent, or Firm*—Yount & Tarolli

[57] ABSTRACT

A fluid roof coating which is applied to a building. The coating is an aqueous air-drying composition preferably comprising, as a suspension:

(a) a first polymer emulsion having a low enough Tg that it will not crystallize at subfreezing temperatures;

(b) a second polymer emulsion which is harder than said first polymer emulsion, dries to a higher gloss finish than said first emulsion polymer, and has a Tg such that the resulting mixture will maintain a low enough Tg that it will not crystallize at subfreezing temperatures; and (c) non-polymeric solids including a pigment; wherein the composition contains at least 25% polymeric solids, no more than 35% non-polymeric solids, and a total solid content of 50% of percentage based on the weight of the composition. The composition when air-dried has a Shore hardness of at least 20, a tensile strength of at least 100 psi, and an elongation of at least 100% when measured at room temperature.

3 Claims, No Drawings

FLUID ROOF SYSTEM

BACKGROUND OF THE INVENTION

This application relates to a roof system for a building. It relates particularly to a roof system with an outer coating which is applied to a building roof substrate (e.g. a roof deck, in the case of an original roof, or an existing roof which is being recovered). The coating is applied on top of the roof substrate in a fluid form, and dries in air to a monolithic sheet of rubber-like material which resists leakage, and protects the roof's substrates from ambient conditions.

Roof systems for commercial, industrial or institutional buildings can be adversely affected by a condition known as thermal stress. Thermal stress is a condition caused by expansion and contraction of the different components of the roof system due to varying ambient temperatures. The different components of the roof system have different coefficients of expansion, so that they expand and contract to different degrees as the ambient temperature varies. When components of a roof system are subjected to varying temperature conditions, the expansion and contraction of the roof's components often causes cracks to form in the roof system, particularly in the system's outer coating. When cracks form in the system, it allows moisture to penetrate, eventually resulting in leakage, and other serious problems for the roof system.

An old and well known technique for forming a roof on a building is to build up a multiple ply system on top of a roof deck. The system is built up with alternating layers of (i) asphalt or tar, and (ii) paper felts. However, there are several problems which are involved in forming such a roof system. If the asphalt or tar is applied hot, as is common, it poses safety hazards. Specifically, it can cause severe burns to the people who work with it. It can also cause fires. Further, it creates dangerous fumes. Also, the system is relatively rigid, and has virtually no elasticity to accommodate movement of components of the building. When the components of such a system are subjected to thermal stress, the system often exhibits the type of cracking discussed above. Still further, when an asphalt or tar based coating is used, it is customary to cover the coating with gravel, or other solids, in order to protect it from ambient conditions. This adds considerable weight to the roof system, which is not desirable.

More recently, there has been developed what is known as a "one-ply" roofing material and process. Pre-formed sheets of rubber-like material are laid on top of the roof substrate, and are adhered to the roof substrate either by (i) bonding the sheets to the entire roof substrate by means of adhesives, or (ii) bonding the perimeters of the sheets to the roof substrate with adhesive, and depositing large specially shaped pieces of gravel or stone on top of the sheets to help hold them in place. An advantage of this system over the multi-ply, built-up roof system is that the single-ply sheet material can stretch in order to accommodate movement of the components of the building due to thermal stress, settling, etc., to resist the formation of cracks.

However, the applicant believes that there are still significant problems involved in the one-ply system. First of all, it is virtually always necessary to use several sheets of the material in order to cover a roof. Because of the fact that several sheets are used, it is necessary to bond the adjacent edges of the sheets to each other.

This creates seams, which are the weakest points in the system and are the primary points where leakage can occur, unless great skill is exercised in bonding the sheets to each other. Still further, in those systems where large specially formed pieces of gravel or stones are used to help hold the sheets in place, the gravel and stones add considerable weight to the roof system.

Further, during the course of development of this invention, a possible fluid roof system was suggested to the applicant by Rohm & Haas, a manufacturer of one of the polymeric emulsions used in the preferred form of the applicant's system. It was suggested that a coating could be formed by adding solids and liquids to that manufacturer's particular polymeric emulsion. In the composition suggested by the supplier, the total solids (polymeric and non-polymeric) constituted about 69% (by weight) of the coating. The polymeric solids constituted about 22% of the coating, and the non-polymeric solids constituted about 46% of the coating. From the applicant's experience, such a coating is undesirable because of the relatively small percentage of polymeric solids, and the relatively high percentage of non-polymeric solids. The coating is more water absorbent than the applicant believes a roof coating should be. Further, the coating has less tear strength, and elongation capability than what the applicant believes a roof coating should have. Additionally, the coating lacks the adhesion capability which the applicant was looking for in a roof coating.

SUMMARY OF THE INVENTION

The present invention provides a new and useful roof system with a coating which departs from the foregoing concepts and improves on those concepts. The coating is easily applied to a building roof substrate in what can be termed a one-step operation. The coating is initially in a fluid form, and is applied to a building roof substrate by rolling, brushing, spraying or similar techniques for applying fluids to a surface. The fluid coating dries in air to a rubber-like consistancy, and forms a monolithic roof coating which can stretch in order to resist cracking as the roof, and its components are subjected to conditions which produce thermal stress.

Additionally, with the coating of the invention, the problems discussed above in connection with systems formed with pre-formed sheets of rubber-like material can be avoided. The coating of the invention can be efficiently applied in fluid form, and dries to a monolithic coating which does not have seams. Thus, it avoids the leakage problems which can occur in systems which have seams. Further, the coating of the invention shows good adhesion to the entire roof substrate, and when dried, shows good elongation and strength characteristics, which enable it to withstand the effects of thermal stress, building shifting, etc., without the formation of leaks or cracks.

Significantly, the applicant's coating also departs from the one type of fluid roof coating which was suggested to the applicant during the development of this invention. According to the invention, the composition comprises a liquid suspension including three basic components. It includes a polymeric emulsion (including polymeric solids and water), non-polymeric solids (including pigment, and a filler or extender) and other additives (e.g. gelling agent, anti-freeze, defoamer, dispersant, stabilizer, pH adjustment agents, etc.). In the development of the coating, the applicant found that the coating would be water resistant, and have highly desirable strength (tensile and tear strength), elongation and hardness characteristics if the polymeric solids comprise at least 25% of the weight of the compositions, and the non-polymeric solids comprise no more than 35% of the weight of the composition. Still further, the applicant found that the foregoing characteristics of the coating could be improved even further if the polymeric and non-polymeric solids were in the amounts set forth above, and if the entire composition comprised at least 50% total solids. Unlike many paints, and unlike the one fluid roofing which was suggested to the applicant, the relatively small percentage of non-polymeric solids, and the relatively large percentage of polymeric solids appears to the applicant to depart from the relative percents of polymeric and non-polymeric solids that are normally found in many polymeric emulsion coatings. Yet, the applicant has found that the foregoing amounts of polymeric and non-polymeric solids achieves a roof coating with properties that are very desirable in a roof system.

Further according to the preferred embodiment, the particular polymer emulsion is not a single polymer emulsion, but in fact a combination of two polymer emulsions. One polymer emulsion is self-plasticizing, has a low enough Tg (glass transition temperature) that it will not crystallize in subfreezing temperatures, has good adhesion, and shows extremely good elongation. The other polymer emulsion can have a higher Tg, as long as in a mixture of the low Tg polymeric emulsion and in the presence of at least 25% polymeric solids and no more than 35% non-polymeric solids it produces a coating which still has a low enough Tg that it will not crystallize in subfreezing temperatures, and has a harder, higher gloss finish. With these polymeric emulsions, the applicant has found that extremely good roof coating characteristics can be obtained.

DESCRIPTION OF THE PREFERRED EMBODIMENT

The preferred form of the invention comprises a formula whose components are as follows:

| | White | Black |
|---|---|---|
| Water | 10% | 10% |
| Ethylene Glycol | 2% | 2% |
| Tamol 850 | 0.4% | 0.4% |
| Nopco NXZ (first stage) | 0.2% | 0.2% |
| Natrosal 250 MR | 0.4% | 0.4% |
| KTPP | 0.2% | 0.2% |
| Ti-Pure R-960/Black Oxide | 6.0% | 5.0% |
| Zinc Oxide | 4.0% | 4.0% |
| Camel Tex | 8.0% | 9.0% |
| Rhoplex E-1685 (63% polymeric solids) | 36.1% | 36.1% |
| Parcryl 400 (50% polymeric solids) | 30.0% | 30.0% |
| Skane M-8 | 0.2% | 0.2% |
| Texanol | 0.6% | 0.6% |
| Nopco NXZ (second stage) | 1.8% | 1.8% |
| Ammonia (28%) | 0.1% | 0.1% |

In the foregoing formula:

(1) the water can be ordinary tap water;

(2) the Ethylene Glycol is used as an anti-freeze;

(3) the Tamol 850 is a Trade Mark of Rohm & Haas Company, Philadelphia, Pa. 19105 ("Rohm & Haas") for a pigment dispersant for emulsion paints. It is used to disperse and stabilize pigments and extenders in aqueous systems (30% solids);

(4) the Nopco NXZ is a Trade Mark of a product sold by the Process Chemicals Division of Diamond Shamrock Corp., 350 Mt. Kemble Avenue, Monistown, N.J. 07960, for a 100% active liquid defoamer for use in synthetic latex emulsions;

(5) the Natrosal 250 MR is a Trade Mark of Hercules, Incorporated, Wilmington, Del. 19899, for a nonionic water-soluble cellulose ether (hydroxyethyl cellulose). It is a white, free-flowing granular powder which is insoluble in organic solvents, yet easily dispersed in cold or hot water to give solutions of varying viscosities;

(6) the KTPP [pentapotassium triphosphate ($K_5P_3O_{10}$)] is used as pigment dispersion in latex emulsion paints;

(7) the Ti-Pure R-960 is a titanium dioxide pigment made by E. I. DuPont DeNemours, Wilmington, Del. It is a white pigment with outstanding chalk resistance for exterior use;

(8) the black oxide is an iron oxide black pigment for emulsion systems;

(9) the zinc oxide is a solid which is used to reduce after-yellowing problems in paints and together with Skane M-8 achieves good mildew resistance;

(10) the Camel Tex is a Trade Mark of Flintkote Stone Products Co., Hunt Valley, Md. 21031, for a material incorporating calcium carbonate. It is used as an extender in the mixture to achieve film hardness and mixture stability;

(11) the Rhoplex E-1685 is a Trade Mark of Rohm & Haas for a low Tg (−50° C.) emulsion polymer with internal plasticizer;

(12) the Parcryl 400 is a Trade Mark of Thibault and Walter, Rutherford and Delancy, Newark, N.J. 07105, for a high Tg (2° C.) emulsion polymer for use in exterior gloss paints;

(13) the Skane M-8 is a Trade Mark of Rohm & Haas. for a microbicide (2-N-Octyl-4-isothiazolin-3-one). It is used to prevent growth of mildew;

(14) the Texanol is a Trade Name of Eastman Chemical Products, Inc., Coatings Chemicals Division, B-280, Kingsport, Tenn. 37662, for an ester alcohol [(2,2,4 Trimethylpentanediol-1,3 Monoisobutyrate) or $(CH_3)_2CHCHOHC(CH_3)_2OCOCH(CH_3)_2$]. It is used to achieve more even film drying, and also as a defoamer and coalescing aid; and

(15) the ammonia (28%) (ammonium hydroxide) is used to raise the pH in the mixture to achieve emulsion stability.

Significantly, as seen from the foregoing formula, the polymeric solids comprise about 38% (by weight) of the composition, and the non-polymeric solids (basically the pigment, the zinc oxide, and the extender) constitute about 18% of the composition. This is believed to be a significant departure from the ratios of those materials normally found in paints and other types of coatings. Moreover, applicant has found that while the foregoing composition forms what applicant believes to be an exceptionally good roof coating, it is possible to form a good roof coating with polymeric solids comprising as low as 25% of the composition, and non-polymeric solids comprising as little as 2% or as much as 35% of the composition. Applicant believes that in such a composition the high percentage of polymeric solids insures a waterproof coating with good adhesion, high tear strength, and good elongation, and the lower percentage of non-polymeric solids will not reduce the tensile strength of the emulsion to an excessively low level, and yet are in sufficient amounts to enhance the hardness of the coating. Applicant prefers a coating with the foregoing amounts of polymeric and non-polymeric solids in a composition of at least 50% total solids. That amount of total solids insures that the applicant's coating will dry with little shrinkage.

The polymeric emulsion is preferably a mixture of two acrylic polymeric emulsion components. The first component (Rhoplex) is self-plasticizing, has a low enough Tg (−50° C.) that it will not crystallize at subfreezing temperatures and shows good stability at high ambient temperatures (e.g. 180° F.). Further, it has good adhesion. Additionally, it will dry, in the presence of air, to a rubber-like consistancy having a good elongation (e.g. 100% or better). The other polymeric emulsion component is a higher Tg (e.g. 2° C.), harder, and higher gloss polymeric emulsion which, when mixed with the first component in the presence of no more than 35% non-polymeric solids, produces a composition which will dry in air to a coating which has a Tg low enough that it will not crystallize at subfreezing temperatures, and also has at least a 20 Shore hardness, a tensile strength of at least 100 psi, and maintains at least 100% elongation at room temperature.

Additionally, applicant has found that the following polymers may be used in place of the polymers disclosed above in the applicant's formula:

1. Rhoplex LC-67 (Rohm & Haas), a self-plasticizing polymer [63% solids (Tg of −45° C.)] in place of the Rhoplex E-1685;
2. Parcryl 450 (Thibault and Walter), [46.5% solids (Tg of 9° C.)] in place of the Parcryl 400;
3. Rhoplex E-330 (Rhom & Haas) [46–48% solids (Tg of 8° C.)] in place of the Parcryl 400;
4. Rhoplex AC-64 (Rohm & Haas), [60% solids, (Tg of +12° C.)] in place of Parcryl 400;
5. Rhoplex AC-388 (Rohm & Haas), [50% solids (Tg of +8° C.)] in place of Parcryl 400; and
6. Rhoplex MC-76 (Rohm & Haas), [47% solids (Tg of +8° C.)] in place of Parcryl 400.

Applicant's composition is prepared in two stages: First, a high-speed grinding step is performed which produces a particle size of 5–6 microns. The first stage components are the water; gelling agent; antifreeze; dispersant; stabilizers; mildew resistant agent; alkaline extender and pigment. Second, at a lower speed than performed in the first step, a mixture of the Rohm & Haas E-1685 emulsion polymer, and the Parcryl 400 emulsion polymer are added to the first stage mixture. Additional components (e.g. pH adjudgment agents, etc.) are added to the composition at any convenient point.

In applying the composition to the building roof, the material must be applied at a temperature above freezing and should be preferably brushed, sprayed or rolled across the entire roofing substrate. The coating is applied to a thickness such that it will dry, in air, to a thickness of at least 20 mils, with the exact thickness depending upon the nature of the particular roof substrate. The composition is then allowed to dry in air to a finished roof coating.

What is claimed is:

1. A method of providing a roof coating to a structure, comprising the steps of providing an aqueous fluid suspension stable at high ambient temperatures comprising (A) a polymeric emulsion composed of an unreacted mixture of (i) a first self-plasticizing acrylic emulsion polymer having a first Tg low enough that it will not become brittle at subfreezing temperatures, and (ii) a second acrylic emulsion polymer which will dry in air to a harder, higher gloss finish than the first acrylic emulsion polymer and which has a different, second Tg such that the Tg of the resulting coating is low enough that it will not become brittle in subfreezing temperatures, and (B) non-polymeric solids, said polymeric emulsion providing polymeric solids constituting at least about 25% of the total weight of said suspension, said non-polymeric solids comprising no more than about 35% of the total weight of said suspension and said polymeric and non-polymeric solids together forming at least about 50% of the total weight of the fluid suspension, applying the fluid suspension onto a roof substrate in a thickness such that it will dry in the presence of air to a thickness of at least about 20 mils, and allowing the fluid suspension to dry in the presence of air to form an elastic coating on the roof substrate, said elastic coating having at least about a 20 Shore hardness, an elongation of at least about 100%, a tensile strength of at least about 100 psi, and a Tg such that the coating will not become brittle in subfreezing temperatures.

2. A method as set forth in claim 1 wherein said first emulsion polymer has a Tg of about −45° C. or less.

3. A method as set forth in claim 2 wherein said fluid suspension additionally contains an effective amount of at least one component selected from the group consisting of an anti-freeze ingredient, a pigment dispersant, a defoamer, a viscosity modified, an anti-yellowing agent, an extender, a microbicide, a pH control agent and mixtures thereof.

* * * * *